US005568909A

United States Patent [19]

Timko

[11] Patent Number: 5,568,909

[45] Date of Patent: Oct. 29, 1996

[54] MOUNTING BRACKET

[76] Inventor: Robert J. Timko, 31609 York Rd., Fraser, Mich. 48026

[21] Appl. No.: 402,533

[22] Filed: Mar. 10, 1995

[51] Int. Cl.[6] ..... F16M 13/00

[52] U.S. Cl. ..... 248/519; 52/298; 52/736.4; 248/530

[58] Field of Search ..... 248/519, 523, 248/530, 300; 52/736.1, 736.3, 736.4, 738.1, 296, 297, 298

[56] References Cited

U.S. PATENT DOCUMENTS

| | | | |
|---|---|---|---|
| 2,909,816 | 10/1959 | Wood | 52/298 |
| 3,451,319 | 6/1969 | Gubela | 52/736.3 X |
| 3,563,502 | 2/1971 | Dayson | 52/298 X |
| 3,809,346 | 5/1974 | Jackson | 248/530 |
| 4,048,776 | 9/1977 | Sato | 52/298 X |
| 4,235,034 | 11/1980 | Black | 248/530 X |
| 4,644,713 | 2/1987 | Lehman | 52/298 X |
| 4,923,164 | 5/1990 | Stenberg | 248/530 |

*Primary Examiner*—Ramon O. Ramirez
*Assistant Examiner*—Derek J. Berger

[57] ABSTRACT

A mounting bracket comprised of a base portion having a generally square configuration. The base portion has apertures formed therethrough inwardly of each of four corners thereof. The device contains a square receiving tube having an open first end, an open second end, and four side walls. Drainage holes exist through two of the side walls opposite one another extending upwardly from the open second end. The open second end is secured to the base portion inwardly of the apertures formed inwardly of the four corners thereof. Each of the four side walls has an aperture formed therethrough. The square receiving tube is dimensioned to receive a wood post therein.

1 Claim, 3 Drawing Sheets

MOUNTING BRACKET

BACKGROUND OF THE INVENTION

1. Field of the Invention

The present invention relates to a mounting bracket and more particularly pertains to housing a wood post for installing on a flat deck for a watertight fit with a mounting bracket used primarily for four by fours.

2. Description of the Prior Art

The use of connection devices is known in the prior art. More specifically, connection devices heretofore devised and utilized for the purpose of connecting various attachments are known to consist basically of familiar, expected and obvious structural configurations, notwithstanding the myriad of designs encompassed by the crowded prior art which have been developed for the fulfillment of countless objectives and requirements.

By way of example, U.S. Pat. No. 5,247,976 to Matthews discloses an adjustable support attachment for mounting to a base.

U.S. Pat. No. 5,236,273 to Gilb discloses a rafter-to-corner plate connection.

U.S. Pat. No. 5,230,198 to Callies discloses a variable pitch connector.

U.S. Pat. No. 5,228,261 to Watkins discloses a floor joist hanger.

U.S. Pat. No. 5,143,472 to Reed et al. discloses an anchor bracket assembly.

While these devices fulfill their respective, particular objective and requirements, the aforementioned patents do not describe a mounting bracket for housing a wood post for installing on a flat deck for a watertight fit.

In this respect, the mounting bracket according to the present invention substantially departs from the conventional concepts and designs of the prior art, and in doing so provides an apparatus primarily developed for the purpose of housing a wood post for installing on a flat deck for a watertight fit.

Therefore, it can be appreciated that there exists a continuing need for new and improved mounting bracket which can be used for housing a wood post for installing on a flat deck for a watertight fit. In this regard, the present invention substantially fulfills this need.

SUMMARY OF THE INVENTION

In the view of the foregoing disadvantages inherent in the known types of connection devices now present in the prior art, the present invention provides an improved mounting bracket. As such, the general purpose of the present invention, which will be described subsequently in greater detail, is to provide a new and improved mounting bracket and method which has all the advantages of the prior art and none of the disadvantages.

To attain this, the present invention essentially comprises a base portion having a generally square configuration. The base portion has a thickness of about one-quarter of an inch. The base portion has apertures formed therethrough inwardly of each of four corners thereof. The apertures have a diameter large enough to allow a large diameter screw or bolt therein. The device contains a square receiving tube having an open first end, an open second end, and four side walls. Drainage holes exist through two of the side walls opposite one another extending upwardly from the open second end. The open second end is secured to the base portion inwardly of the apertures formed inwardly of the four corners thereof. Each of the four side walls has an aperture formed therein. Each of the apertures has a diameter less than that of the apertures of the base plate. The square receiving tube is dimensioned to receive a four by four wood post therein. The device contains a plurality of concrete anchor bolts, wood screws or lag bolts. Each of the anchor bolts is dimensioned to be received through the apertures of the base plate to secure the base plate to a concrete porch, wooden deck or a flat roof. The device contains a plurality of lag screws. Each of the lag screws is dimensioned to be received through the apertures of the square tube to secure the four by four wood post thereto.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved mounting bracket which has all the advantages of the prior art connection devices and none of the disadvantages.

It is another object of the present invention to provide a new and improved mounting bracket which may be easily and efficiently manufactured and marketed.

It is a further object of the present invention to provide a new and improved mounting bracket which is of durable and reliable construction.

An even further object of the present invention is to provide a new and improved mounting bracket which is susceptible of a low cost of manufacture with regard to both materials and labor, and which accordingly is then susceptible of low prices of sale to the consuming public, thereby making such a mounting bracket economically available to the buying public.

Still yet another object of the present invention is to provide a new and improved mounting bracket which provides in the apparatuses and methods of the prior art some of the advantages thereof, while simultaneously overcoming some of the disadvantages normally associated therewith.

Even still another object of the present invention is to provide a new and improved mounting bracket for housing a wood post for installing on a flat deck for a watertight fit.

Lastly, it is an object of the present invention to provide a new and improved mounting bracket comprised of a base portion having a generally square configuration. The base portion has apertures formed therethrough inwardly of each of four corners thereof. The device contains a square receiving tube having an open first end, an open second end, and four side walls. Drainage holes exist through two of the side walls opposite one another extending upwardly from the open second end. The open second end is secured to the base portion inwardly of the apertures formed inwardly of the four corners thereof. Each of the four side walls has an aperture formed therethrough. The square receiving tube is dimensioned to receive a wood post therein.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts through the various Figures.

DESCRIPTION OF THE PREFERRED EMBODIMENT

Figure 1:
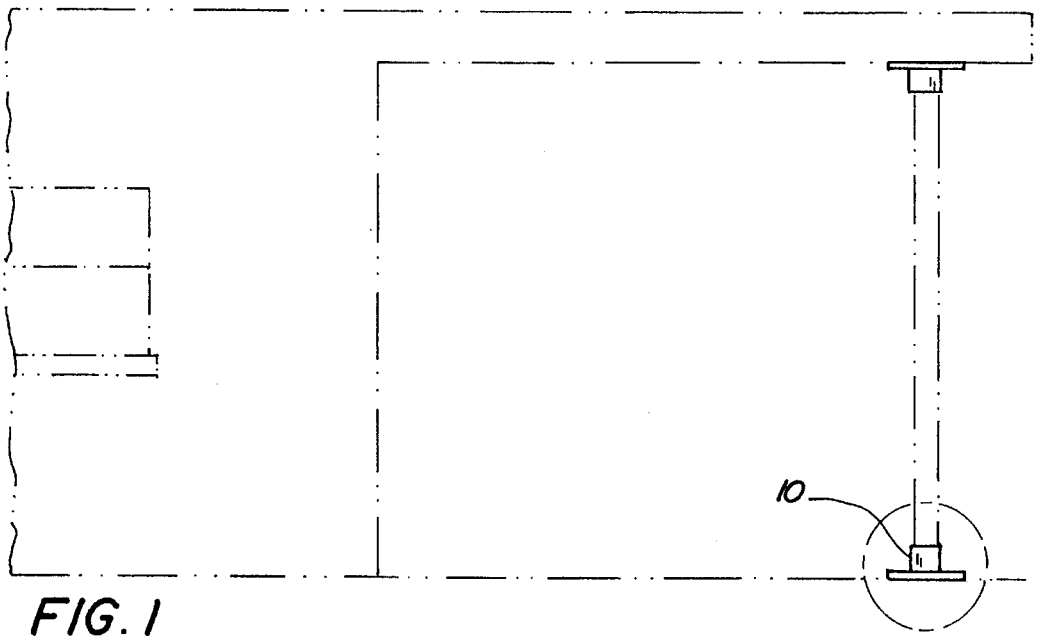
FIG. 1 is a side view of the present invention in use.
Figure 2:
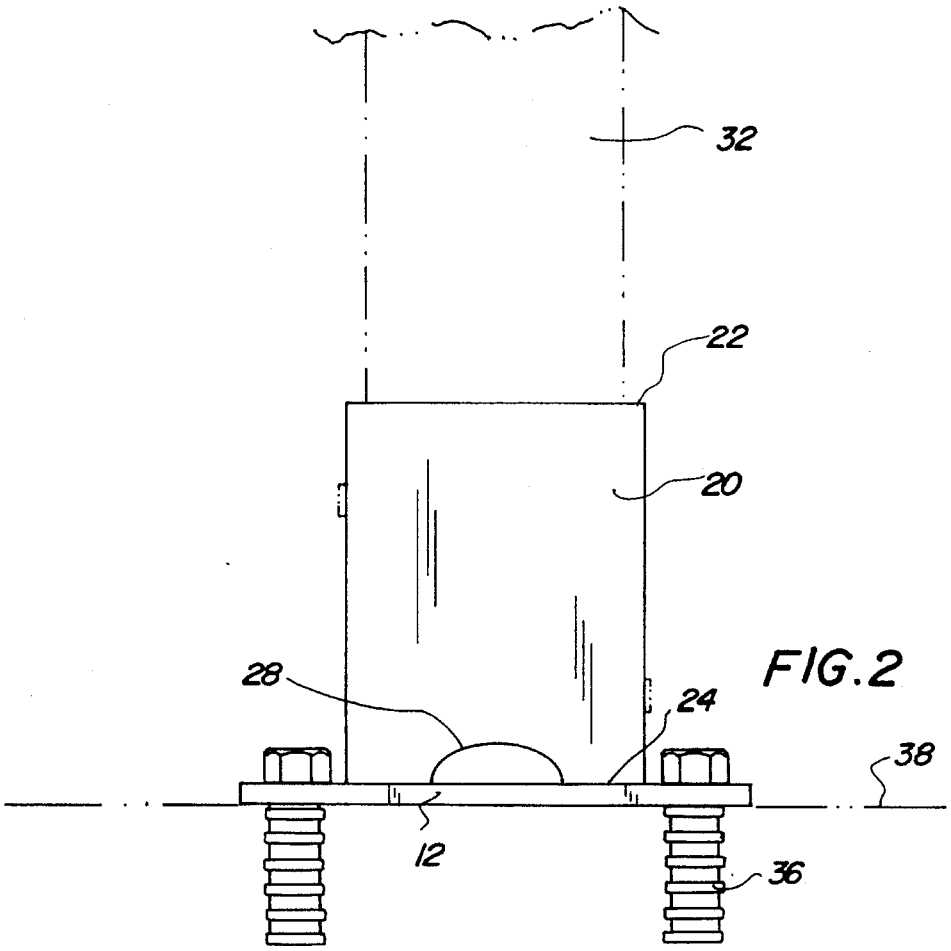
FIG. 2 is a side elevation view of the present invention.
Figure 3:
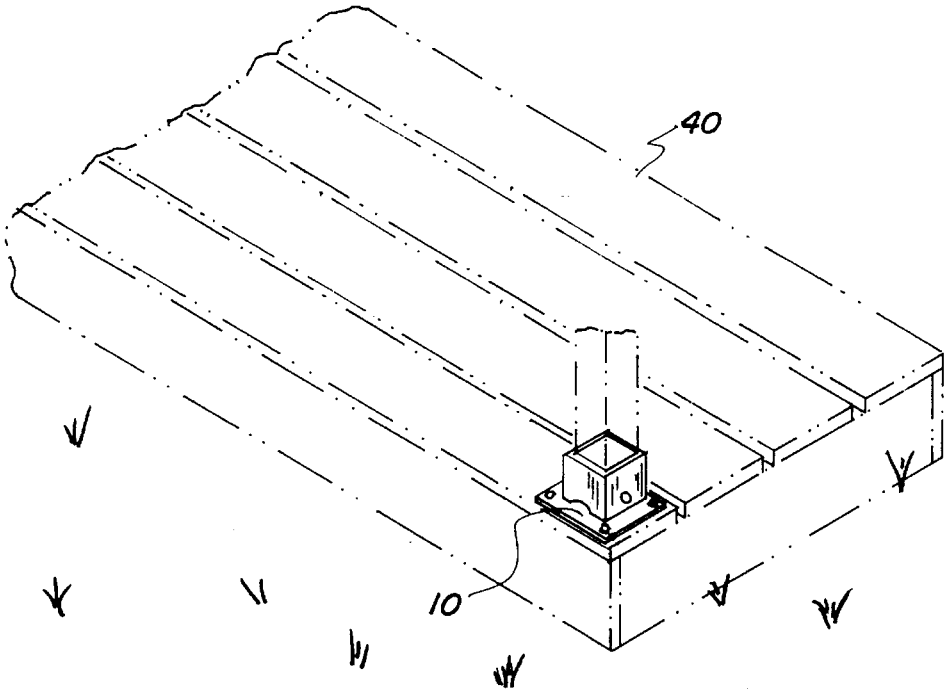
FIG. 3 is a plan perspective view of the present invention in use.
Figure 4:
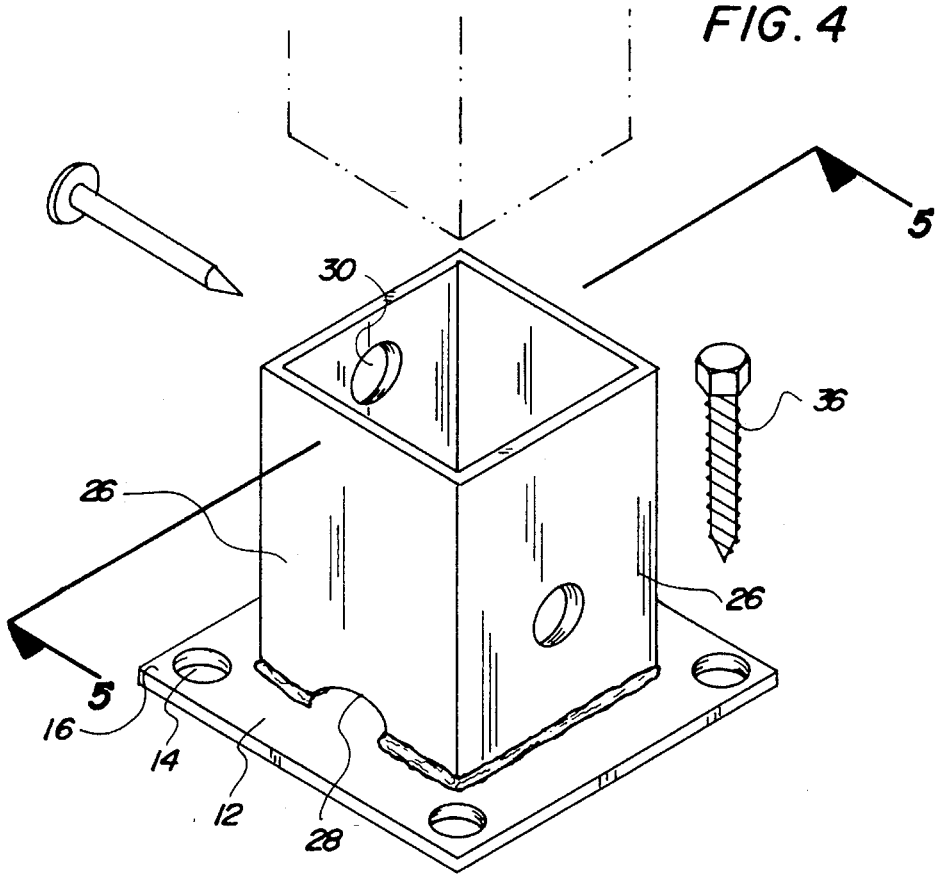
FIG. 4 is a perspective view of the preferred embodiment of the mounting bracket constructed in accordance with the principles of the present invention.
Figure 5:
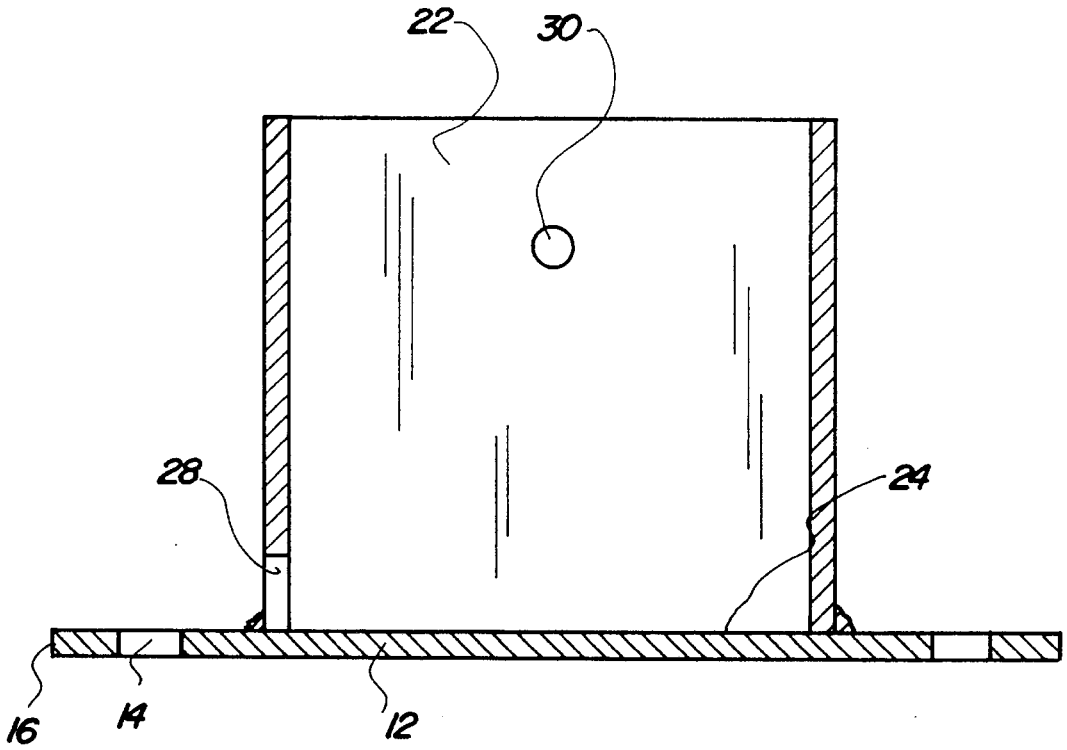
FIG. 5 is a cross-sectional view as taken along line 5—5 of FIG. 4.
Figure 6:
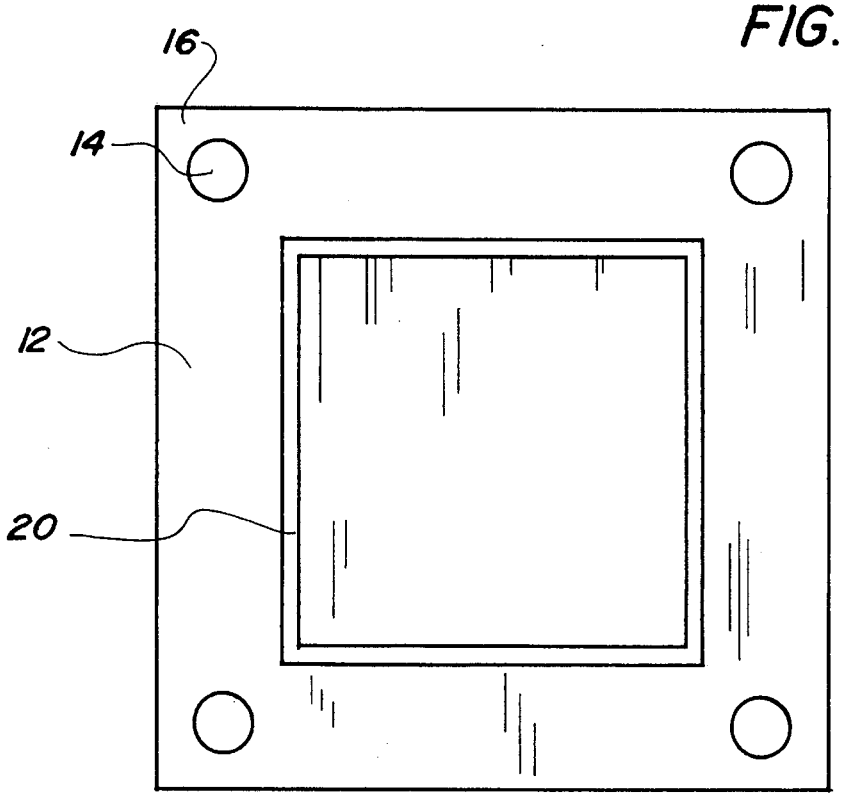
FIG. 6 is a plan view of the preferred embodiment of the present invention.

With reference now to the drawings, and in particular, to FIGS. 1–6 thereof, the preferred embodiment of the new and improved mounting bracket embodying the principles and concepts of the present invention and generally designated by the reference number 10 will be described.

Specifically, it will be noted in the various Figures that the device relates to a new and improved mounting bracket for housing a wood post for installing on a flat deck for a watertight fit. In its broadest context, the device consists of a base portion, a square receiving tube, a plurality of concrete anchor bolts, and a plurality of nails.

The device 10 contains a base portion 12 having a generally square configuration. The base portion 12 has a thickness of about one-quarter of an inch. The base portion 12 has apertures 14 formed therethrough inwardly of each of four corners 16 thereof. The apertures 14 have a diameter large enough and counter sunk to allow a large diameter flat head screw or bolt to be level with the plane of the base plate therein. The base portion 12 is flat, therefore prohibiting any uses other than on flat surfaces. Before the base portion 12 is secured to a wood deck or a concrete patio, a caulk sealant might be applied first to prevent any damages caused by water.

The device 10 contains a square receiving tube 20 having an open first end 22, an open second end 24, and four side walls 26. The square receiving tube 20 has a drainage aperture 28 formed through one of the four sidewalls 26 extending upwardly from the open second end 24. The drainage aperture 28 allows any water that might enter the square receiving tube exit thereby preventing any water damage from occurring. The open second end 24 is secured to the base portion 12 inwardly of the apertures 14 formed inwardly of the four corners 16 thereof. Each of the four side walls 26 has an aperture 30 formed therein. Each of the apertures 30 has a diameter less than that of the apertures 14 of the base plate 12. The square receiving tube 20 is dimensioned to receive a four by four wood post 32 therein through the open first end 22 thereof. The square receiving tube 20 only covers a little more than half of the surface of the base portion 12. A larger square receiving tube 20 and base portion could be used to accommodate a larger wood post such as a six by six.

The device 10 contains a plurality of concrete anchor bolts 36. Each of the anchor bolts 36 is dimensioned to be received through the apertures 14 of the base plate 12 to secure the base plate 12 to a concrete porch 38 or wooden deck 40.

The device 10 contains a plurality of nails 44. Each of the nails 44 is dimensioned to be received through the apertures 30 of the square receiving tube 20 to secure the four by four wood post 32 thereto.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and the manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modification and changes will readily occur to those skilled in the art, it is not desired to limit the invention to the exact construction and operation shown and described, and accordingly, all suitable modification and equivalents may be resorted to, falling within the scope of the invention.

What is claimed as being new and desired to be protected by Letters Patent of the United States is as follows:

1. A mounting bracket for housing a wood post for installing on a flat deck for a watertight fit comprising, in combination:

a base portion having a generally square configuration, the base portion having a thickness of about one-quarter of an inch, the base portion having apertures formed therethrough inwardly of each of four corners thereof, the apertures having a diameter large enough to allow a large diameter screw or bolt therein;

a square receiving tube having an open first end, an open second end, and four side walls, the square receiving tube having drainage holes existing through two of the sidewalls opposite one another extending upwardly from the open second end thereby allowing water to drain away from the bracket and off of the flat deck, the open second end secured to the base portion inwardly of the apertures formed inwardly of the four corners thereof, each of the four side walls having an aperture formed therein, each of the apertures having a diameter less than that of the apertures of the base plate, the square receiving tube dimensioned to receive a four by four wood post therein;

a plurality of concrete anchor bolts, wood screws or lag bolts, each of the anchor bolts, wood screws or lag bolts being dimensioned to be received through the apertures of the base plate to secure the base plate to a concrete porch, wooden deck or flat roof;

a plurality of lag screws, each of the lag screws dimensioned to be received through the apertures of the square receiving tube to secure the four by four wood post thereto.

* * * * *